United States Patent [19]

Andersson et al.

[11] 4,111,611

[45] Sep. 5, 1978

[54] SUBMERSIBLE PUMP LOCKING SYSTEM

[75] Inventors: Karl-Gunnar Andersson, Sodertalje; Karl Evert Sjostrand, Taby, both of Sweden

[73] Assignee: ITT Industries, Incorporated, New York, N.Y.

[21] Appl. No.: 820,199

[22] Filed: Jul. 29, 1977

[30] Foreign Application Priority Data

Oct. 8, 1976 [SE] Sweden ..... 7611187

[51] Int. Cl.[2] ..... F04B 17/00

[52] U.S. Cl. ..... 417/360; 187/95; 254/192

[58] Field of Search ..... 417/360; 292/302, 98; 254/195, 196, 192; 187/95

[56] References Cited

U.S. PATENT DOCUMENTS

| | | | |
|---|---|---|---|
| 2,385,276 | 9/1945 | Hart et al. | 187/95 |
| 2,468,683 | 4/1949 | Michal | 292/302 X |
| 3,282,356 | 11/1966 | Paulson et al. | 187/95 X |
| 3,771,914 | 11/1973 | Crespo | 417/360 |
| 3,885,714 | 5/1975 | Sjostrand | 417/360 X |

*Primary Examiner*—Carlton R. Croyle
*Assistant Examiner*—R. E. Gluck
*Attorney, Agent, or Firm*—John T. O'Halloran; Peter C. Van Der Sluys

[57] ABSTRACT

An automatic locking system is provided for securing a submersible pump to vertical guide wires. The pump is automatically locked to the wires upon lowering of the pump and released upon raising the pump. Stationary cams in the pumping station actuate the locking system. The system assures locking when the pump is lowered and eliminates the need for manual unlocking by the serviceman when raised.

5 Claims, 2 Drawing Figures

SUBMERSIBLE PUMP LOCKING SYSTEM

BACKGROUND OF THE INVENTION

1. Field of the Invention

This invention relates to submersible pumps and, more particularly, to a locking device for securing the pump to guide wire.

2. Description of the Prior Art

Pump units designed to work entirely or partly immersed in liquid are inconvenient to maintain if the pump units are permanently installed. In order to make maintenance more consistent, it is known to arrange for the pump units to be lowered into the pumped medium guided along guides and, in their lowered position, bearing against a rigidly arranged outlet pipe for the pumped liquid. The connection of the pump unit must in this position close tightly against the outlet pipe without needing to be attached to it by screws or the like.

The guides are usually steel pipes or sometimes wires. In both cases the pump unit is provided with some sort of guide means which more or less entirely clasps the guide. The guide means must then be so formed that the pump unit is easy to disconnect from the guides after having been raised. At the same time there will be no risks allowed that the pump unit should be disconnected by mistake during lowering and raising operations.

These problems are solved relatively easy by guides made of rigid pipes; however, when the guides are wires, it has up to now been common to attach the guide means around the guide wires by screws. Thus, much time is wasted whenever the pump unit must be disconnected for service and it also presents a risk that the serviceman may forget to fully lock the pump to the guide wires before lowering the pump.

SUMMARY OF THE INVENTION

The problem of providing a quick and automatic locking of the pump unit has, according to the invention, been solved by a device comprising:

(a) providing the pump with one or more rigidly mounted fork-shaped guiding means for clasping the guides, (b) a locking means mounted on the pump and being movable in the plane of the guiding means perpendicular to the guides and which in its locked position together with the guiding means close about the guides, while in its unlocked position allows for disconnecting of the pump from the guides and (c) on a level somewhat below the upper ends of the guides rigidly mounted guiding cams which automatically shift the locking means to a locked and unlocked position respectively when the pump unit is lowered and raised respectively.

DESCRIPTION OF THE PREFERRED EMBODIMENT

Figure 1:
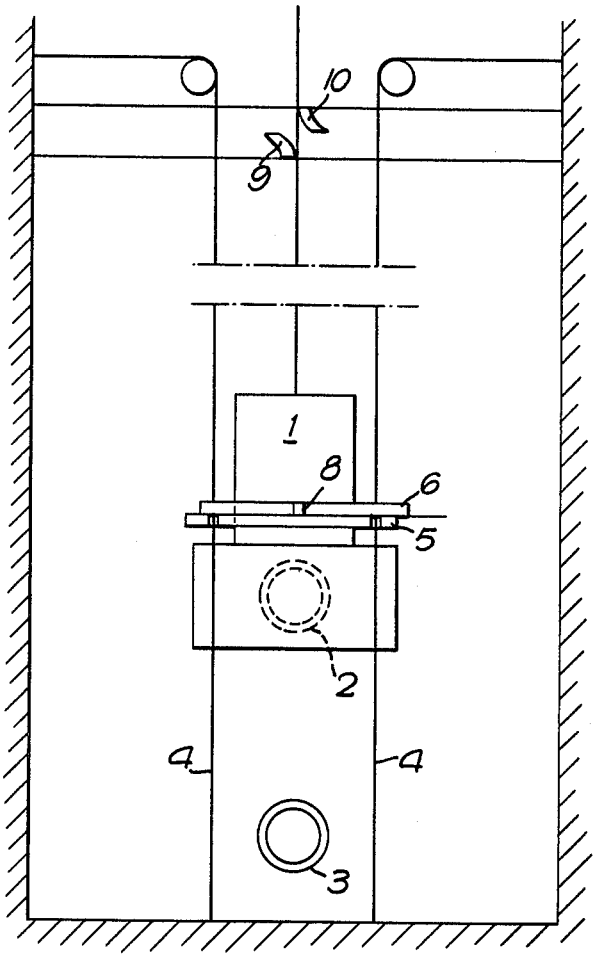
FIG. 1 shows an overall view of a pumping station provided with a locking device according to the invention.

In the FIGS. 1 stands for a submersible pump unit with outlet 2, 3 stands for the rigidly mounted outlet pipe, 4 are guides, 5 and 6 are guiding means and locking means respectively, 7 are locking bars, 8 is operating means and 9 and 10 finally are operating cams.

Figure 2:
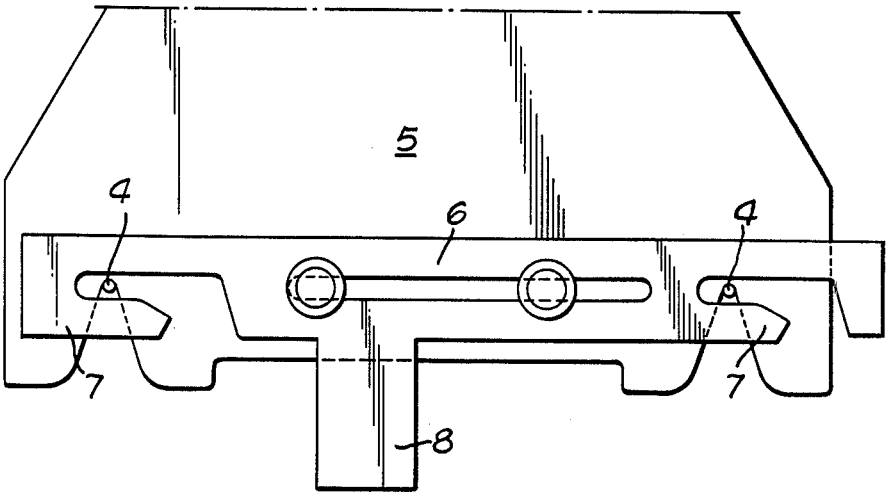
FIG. 2 shows a detail view of the locking device seen from above.

By installation, the pump unit 1 is brought against the two guides 4 at their upper ends until the guides touch bottom in the fork-shaped notches of the guiding means 5. The pump unit is now locked in three directions in the horizontal plane with regard to the guides 4. The pump unit is then lowered along the guides. An operating cam 9 is rigidly mounted in the pumping station and so oriented that when the pump unit is lowered to a certain level, operating means 8 on the locking means 6 is moved in a direction, to the right in FIG. 2, that the locking bars 7 of the locking means grip behind the guides 4. Guides 4 are then entirely surrounded by the guiding means 5 and the bars 7 and thus the pump unit is entirely controlled and can be lowered to its operating position, without any risk of being involuntarily disconnected. The locking means 6 is then fixed in its locking position by, for instance, some sort of spring lock.

When raising the pump unit, it is entirely controlled by the guides 4 up to a point just below their upper ends. Another operating cam 10 is here arranged to influence on the operating means 8 and bring the locking means 6 to the left in FIG. 2, where the locking bars 7 are in an unlocked position. The pump unit is now free to be disconnected from the guides 4 and can be brought away for service.

In place of the slidable locking bars 7, the locking means 6 may be provided with turnable hooks, rolls or other means which, together with the guiding means 5, form closed controlling devices for the guides 4.

According to the invention, a device is thus obtained which automatically connects and disconnects a submersible pump unit from its guides. This automatic device means that mounting work in often hard and risky places is avoided and also that the securing of the pump unit to the guides will never be overlooked. This is especially important with the very deep pumping stations which now become more prevalent.

In the embodiment described above, the guides have the form of wires. The device according to the invention is however also useful with stiff guides such as pipes which are used in conventional pumping stations.

What is claimed is:

1. A device for automatically connecting a submersible pump to a guide disposed in a pumping station, comprising:

at least one guiding means mounted to said pump for engaging the guide;

movable locking means associated with said guiding means for cooperating therewith to lock the guide in the guiding means when in a locked position and to allow for disconnection of the pump from the guide in an unlocked position; and operating cams mounted in said pumping station at a level somewhat below the upper end of the guide for engaging the locking means to automatically move the locking means to a locked and unlocked position respectively when the pump unit is lowered and raised.

2. A device as described in claim 1, wherein the guiding means receives the guide and encloses the guide on three sides thereof and the locking means is movable relative to the guiding means to enclose the guide on a fourth side thereof when in the locked position.

3. A device as described in claim 2, wherein the locking means is slidably mounted to the guiding means and may be slid into and out of the locked position.

4. A device as described in claim 1, wherein the locking means includes an extended portion that engages the operating cams upon raising and lowering of the pump.

5. A device as described in claim 1 wherein the guiding means includes at least two fork-shaped openings for engaging at least two guides and the locking means is slidably mounted to said guiding means and includes locking bars that are slid across the fork-shaped openings so that the guides are encircled by the guiding means and locking means.

* * * * *